US006908013B2

(12) United States Patent
Thomson et al.

(10) Patent No.: US 6,908,013 B2
(45) Date of Patent: Jun. 21, 2005

(54) TAMPER-EVIDENT DEVICE

(75) Inventors: David William Thomson, Bannockburn (GB); Egidio Mezzadra, Torre d'Isola (IT)

(73) Assignee: Daniel Montgomery & Son Limited, Glasglow (GB)

( * ) Notice: Subject to any disclaimer, the term of this patent is extended or adjusted under 35 U.S.C. 154(b) by 0 days.

(21) Appl. No.: 10/719,232

(22) Filed: Nov. 20, 2003

(65) Prior Publication Data

US 2004/0129729 A1 Jul. 8, 2004

Related U.S. Application Data

(63) Continuation of application No. PCT/GB02/02404, filed on May 22, 2002.

(30) Foreign Application Priority Data

May 25, 2001 (GB) ..... 0112726

(51) Int. Cl.[7] ..... B67D 5/32

(52) U.S. Cl. ..... 222/153.06; 222/153.1; 215/28; 215/251; 215/253; 220/268; 220/276

(58) Field of Search ..... 222/153.01, 153.05, 222/153.06, 153.09, 153.1, 153.13, 153.14; 215/28, 201, 203, 214, 250, 251, 253; 220/265, 266, 268, 276

(56) References Cited

U.S. PATENT DOCUMENTS

| | | | | | |
|---|---|---|---|---|---|
| 2,361,449 | A | * | 10/1944 | Benzinger | 215/246 |
| 3,335,889 | A | * | 8/1967 | Brumme | 215/252 |
| 4,000,834 | A | | 1/1977 | Whiley | 222/180 |
| 4,540,100 | A | * | 9/1985 | Willis | 215/252 |
| 4,848,614 | A | * | 7/1989 | Csaszar | 215/252 |
| 5,484,084 | A | | 1/1996 | Junqueras Guerre | 222/147 |
| 5,711,443 | A | * | 1/1998 | Bennett | 215/256 |
| 6,619,492 | B2 | * | 9/2003 | Battegazzore | 215/21 |

FOREIGN PATENT DOCUMENTS

| | | |
|---|---|---|
| EP | 0 627 359 A1 | 12/1994 |
| EP | 0 847 930 A1 | 6/1998 |
| GB | 1 262 743 | 2/1972 |
| GB | 2 355 287 | 3/2002 |
| WO | WO 00/75033 A1 | 12/2000 |

* cited by examiner

*Primary Examiner*—Michael Mar
*Assistant Examiner*—Patrick Buechner
(74) *Attorney, Agent, or Firm*—Notaro & Michalos P.C.

(57) ABSTRACT

There is disclosed a tamper-evident device for a closure assembly adapted to be applied to a mouth of a container, for example, a neck of a bottle. There has been identified a need for an improved tamper-evident device which does not have any parts which are removed upon initial opening and which are liable to be reattached by counterfeits or the like. Accordingly the present invention provides a tamper-evident device comprising a sleeve member which comprises a first portion associated with a second portion by a frangible portion therebetween, and wherein said first portion is adapted to be applied to a mouth and neck portion of a container, and said second portion is associated with a container closure member, and wherein an initial container opening operation causes said frangible portion to fracture or break such that when the container is reclosed said first and second portions are located in a spaced apart relationship to one another.

36 Claims, 8 Drawing Sheets

TAMPER-EVIDENT DEVICE

CROSS-REFERENCE TO RELATED APPLICATIONS

This application is a continuation of International application PCT/GB02/02404 filed May 22, 2002, the entire content of which is expressly incorporated herein by reference thereto.

FIELD OF INVENTION

The present invention relates to a tamper-evident device or a closure assembly adapted to be applied to a mouth of a container, for example, a neck of a bottle. The invention particularly, thought not exclusively, relates to a tamper-evident non-refillable snap-on fitment.

BACKGROUND OF THE INVENTION

For various reasons, it may be desirable to ensure that a used container, such as a bottle intended to contain a liquid (e.g., spirits such as alcoholic beverages), is not re-filled with a replacement quantity of another liquid, the characteristics and quality of which may differ from the original contents. Attempts to provide closures which make such re-filling difficult are not always proof against determined tampering. While it is considered advantageous to provide a tamper-indicating means which provides evidence that the bottle and its original contents are intact, if the bottle is resealable with a substitute cap or closure, there may be little to indicate to a purchaser that the bottle has been tampered with and that the contents may be inferior to the original contents.

It has, therefore, been found desirable to provide a closure which cannot be removed without an extreme level of effort, or breakage being caused to the bottle. Such an arrangement is shown, for example, in GB Patent application No. 2 274 837 also by the present applicant, selected merely by way of illustration.

While it is very important that an original closure cannot be removed without visible damage or breakage being caused either to the closure and/or to the bottle, it has been found that a closure that cannot readily be removed will become the target of attempts to re-fill the container by overcoming the feature provided in the closure intended to hinder or prevent such refilling. Therefore, in addition to providing devices to prevent re-filling of bottles, there is a need to provide such devices with further tamper-indicating features which, while not acting in any preventive role, give a clear irremovable and/or irreversible indication that a bottle has been opened since being originally filled with the genuine contents. Such clear indicators have been somewhat lacking in previous closure designs.

Furthermore, there is a need for simple designs of closure assemblies allowing easy and reliable manufacture, assembly and fitting to bottle necks. Such simplicity has been somewhat lacking in previous closure designs.

The present invention now obviates or at least mitigates at least one of the aforementioned problems/disadvantages in the prior art.

SUMMARY OF INVENTION

The present invention provides an improved tamper-evident device which does not have any parts which are removed upon initial opening and which are liable to be reattached by counterfeiters or the like.

According to a first aspect of the present invention, there is provided a tamper-evident device comprising a sleeve member which comprises a first portion associated with a second portion by means of a frangible portion therebetween, and wherein said first portion is adapted to be applied to a mouth and neck portion of a container, and said second portion is associated with a container closure member, and wherein an initial container opening operation causes said frangible portion to fracture or break such that when the container is reclosed said first and second portions are located in a spaced apart relationship to one another.

Preferably the frangible portion is provided adjacent respective circumferential edges of the first and second portions. Also, either or both of the respective circumferential edges may retract or recoil away from the other during a container opening operation when the frangible portion fractures or breaks. The retraction or recoil is preferably accompanied by a concomitant circumferential contraction of at least one of the edges inwardly of the respective first or second portion to provide at least one edge having a smaller circumference or diameter than an adjacent portion of the respective first or second portion.

The retraction or recoil movement is important as it advantageously results in a permanent deformation of the first and/or second portions such that when the container is reclosed the circumferential edges do not abut together thus revealing a void or gap located between the first and second portions. This visual indicator evidences that the container (and tamper-evident device) has been opened.

Preferably, the container closure member includes a circumferential groove, which may further provide a circumferential lip portion located below and adjacent to the circumferential groove.

Preferably, during an initial container opening operation, the first circumferential edge recoils/retracts and circumferentially contracts into the circumferential groove to become positioned circumferentially behind the circumferential lip. This action positions the circumferential lip between the first and second circumferential edges in an obstructive manner such that when the container is reclosed by re-applying the closure member, the first and second portions of the first sleeve member are spaced apart by the circumferential lip portion located therebetween.

The frangible portion is generally located in a further circumferential groove provided between or adjacent the first and second portions of the sleeve member.

Preferably the frangible portion is located substantially at an apex or base of the further circumferential groove.

The frangible portion may be provided as a continuous weakened portion such as a circumferential scored line or alternatively the frangible portion may comprise intermittent shearable links which join the first portion to the second portion or a combination of these.

The edge of the first portion may provide a circumferential first beaded portion on the first portion, and in a same manner the edge of the second portion may provide a circumferential second beaded portion on the portion.

The first sleeve member may comprise any suitable material, and preferably this material comprises a metal, or metallic based material.

Preferably the metal or metallic based material substantially comprises aluminum, or an alloy thereof, particularly rolled aluminum.

Without wishing to be bound by theory, when the first sleeve member comprises rolled aluminum, the retraction, recoil and/or contraction on breakage of the frangible portion is believed to be due to release of a tension introduced into the aluminum during forming of the sleeve member.

Also, advantageously, aluminum provides a good medium for application of printing dyes, inks, paints or the like such that messages, logos, images, names, and other information may be carried by the sleeve member.

The container closure member may be a cap which desirably includes a threaded portion which allows a rotational movement of the cap during a container opening operation.

The tamper-evident device may include a pouring outlet device adapted to be secured to the mouth of a container for liquid, the container closure member may be a cap adapted to close an outlet of the pouring outlet device, and the sleeve member may be adapted to receive at least part of the pouring outlet device.

Preferably the second portion of the sleeve member is adapted to receive at least part of the cap. The cap is generally received in a tight interference fit to the second portion, but may be optionally rotatable with respect to the second portion of the sleeve member upon application of sufficient force.

The pouring outlet device is desirably a non-refillable and/or a non-removable device. Desirably the pouring outlet device comprises a further sleeve member which is adapted to lie around the mouth and neck portion of the container, and further comprises a valve seat body which is at least partially receivable within at least part of the neck portion of the container, and wherein the valve seat body is at least partially surrounded by the further sleeve member.

At least the first portion of the sleeve member is preferably adapted to receive at least part of the further sleeve member, preferably in a tight interference fit but optionally rotatable with respect to the further sleeve member upon application of sufficient force.

Preferably the further circumferential groove of the sleeve member is located within the circumferential groove provided on the container closure member (cap). This positioning ensures that when the container is opened by twisting the cap, and fracturing or breaking the shearable links, the edge of the second portion of the sleeve member remains within the groove provided on the cap, and the edge of the first portion of the sleeve member progressively moves out of the groove provided on the cap as the cap is removed away from the pouring outlet device and the first portion. On removing the contact between the cap and the first portion of the first sleeve member, the first edge retracts to cause a contraction of circumference such that the resulting circumference is less than that of a cap portion which is located below the groove therein. This cap portion is preferably provided as a circumferential lip on the cap.

When the cap is re-applied to the pouring outlet device, a stop position is reached when the circumferential lip of the cap rests or sits upon the edge of the first portion of the sleeve member, thus preventing the cap being returned to its original starting position. A gap or void remains between the first and second portions of the sleeve member thus exposing the circumferential portion of the cap, which includes the circumferential lip which was originally encased or enclosed within the first sleeve member. A void may also exist between the lower edge of the cap and a cap seating surface of the device.

Advantageously the exposed circumferential portion of the cap may be distinctly colored and/or printed with information, promotional messages or the like.

According to a second aspect of the present invention, there is provided a container including a tamper-evident device according to the first aspect.

The container is preferably a container for liquid.

The container is preferably a bottle.

The container may be a glass bottle, and may be adapted for containment of liquid, such as alcoholic drinks or beverages, e.g., spirits such as vodka, whisky, brandy, gin or the like.

According to a third aspect of the present invention there is provided a combination of a container and a tamper-evident device according to the first aspect.

According to a fourth aspect of the present invention there is provided an alcoholic drinks product comprising an alcoholic substance packaged in the combination according to the third aspect.

According to a fifth aspect of the present invention there is provided a method of manufacturing a tamper-evident device comprising the steps of (a) providing a sleeve member;

(b) providing a pouring outlet device comprising a further sleeve member adapted to be secured to a mouth or neck portion of a container for liquid, and a container closure member releasable securable to the further sleeve member;

(c) disposing-the pouring outlet device at least partly within the sleeve member;

(d) forming a substantially circumferential frangible portion around the sleeve member.

This method is particularly advantageous in mass production.

Preferably, the method includes the further step of securing the sleeve member and pouring outlet device one to the other by forming a lip on an open end of the sleeve member so as to entrap the pouring outlet device within the sleeve member.

The tamper-evident device so formed may comprise a unitary assembly for snap-on application to a mouth and neck portion of a container.

BRIEF DESCRIPTION OF THE DRAWINGS

Embodiments of the present invention will now be described by way of example with reference to the accompanying drawings, which are:

FIG. 1(*b*) an enlarged view of the circled part of the tamper-evident device of FIG. 1;

FIG. 3(*b*) an enlarged view of the circled part of the tamper-evident device of FIG. 3(*a*);

FIG. 5(*b*) an enlarged view of the circled cut-away view of FIG. 5(*a*).

FIG. 7(*b*) an enlarged view of the circled part of the tamper-evident device of FIG. 7(*a*);

DETAILED DESCRIPTION OF THE PREFERRED EMBODIMENTS

The device of the invention has been named the "ALU-snap" (Trade Mark) tamper-evident device.

Figure 1A:
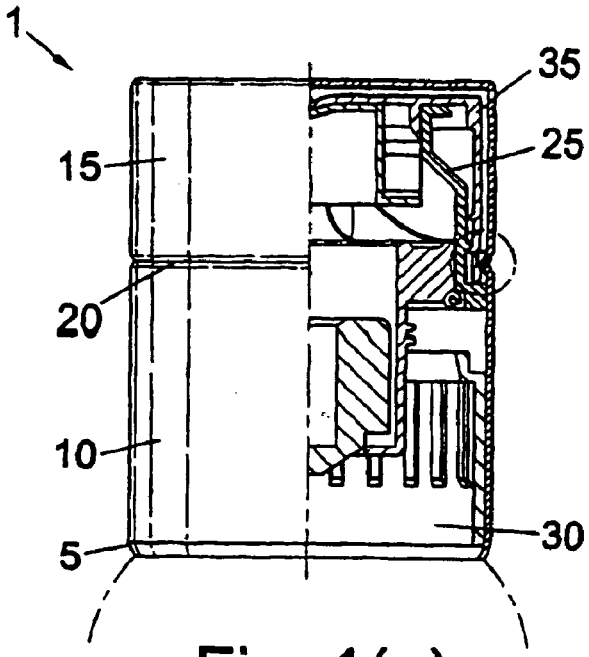
FIG. 1(*a*) a partially cut-away side view of a tamper-evident device according to a first embodiment of the present invention prior to initial opening including a pouring outlet device and in combination with a bottle neck shown in phantom lines.
Figure 1B:
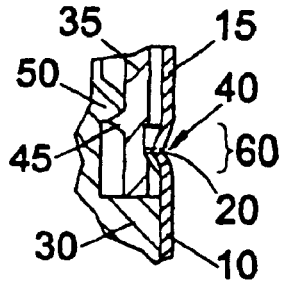

With reference initially to FIG. 1(*a*), there is illustrated a tamper-evident device, generally designated by reference numeral 1, according to a first embodiment of the present invention. The device 1 comprises a sleeve member 5 which comprises a first portion 10 associated with a second portion 15 by means of a frangible portion 20 therebetween. The sleeve member 5 has a closed distal end and an open proximal end. The first portion 10 is adapted to receive a further sleeve member 30 which is part of a pouring outlet device 25 which in this embodiment is a non-refillable and non-removable device. A lower section of the further sleeve member 30 fits within the first portion 10 in a tight interference fit but rotatable with respect to the first portion 10.

The second portion 15 is associated with a container closure member, shown as cap 35, which is received within the second portion 15 in a tight interference fit but rotatable with respect to the second portion 15.

Referring to FIG. 1(*b*), the first portion 10 of the sleeve member 5 is shown associated with the second portion 15 of the first sleeve member 5 by means of the frangible portion 20. The first and second portions 10, 15 are in a close interference fit with the further sleeve member 30 and the cap 35, respectively.

The frangible portion 20 is located within groove 40 on the sleeve member 5, which is provided between the first and second portions 10, 15. Groove 40 is shown located within a further groove 60 provided on cap 35. Also shown is a threaded portion 45 on cap 35 which engages with a corresponding threaded portion 50 provided on the pouring outlet device 25.

In use, the cap 35 is rotated (normally anticlockwise) in an initial container opening operation which causes the frangible portion 20 to break as described below.

Figure 2:
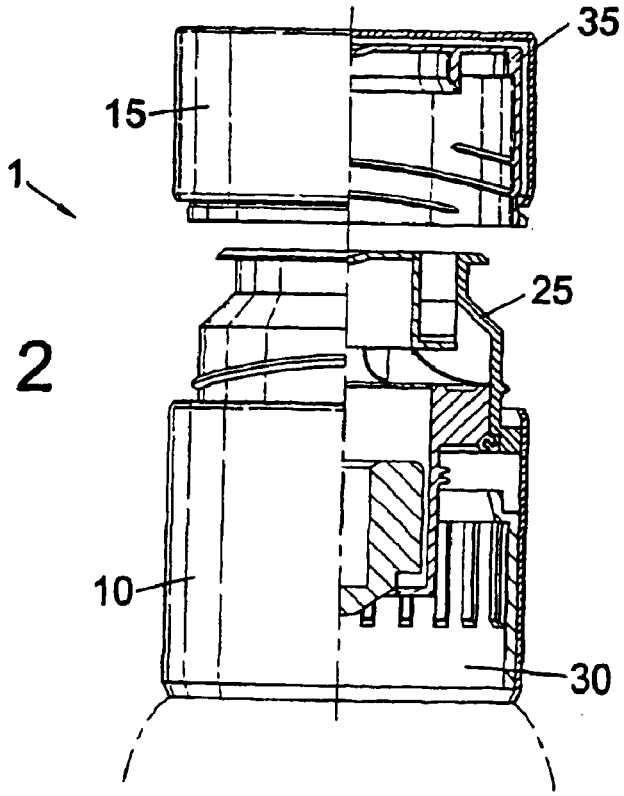
FIG. 2 a partially cut-away side view of the tamper-evident device of FIG. 1(*a*) in use with a closure member thereof removed.

Referring to FIG. 2, the cap 35 and second portion 15 associated therewith are shown in a removed or open position away from the pouring outlet device 25 which clearly shows the first portion 10 still associated with the further sleeve 30.

Figure 3A:
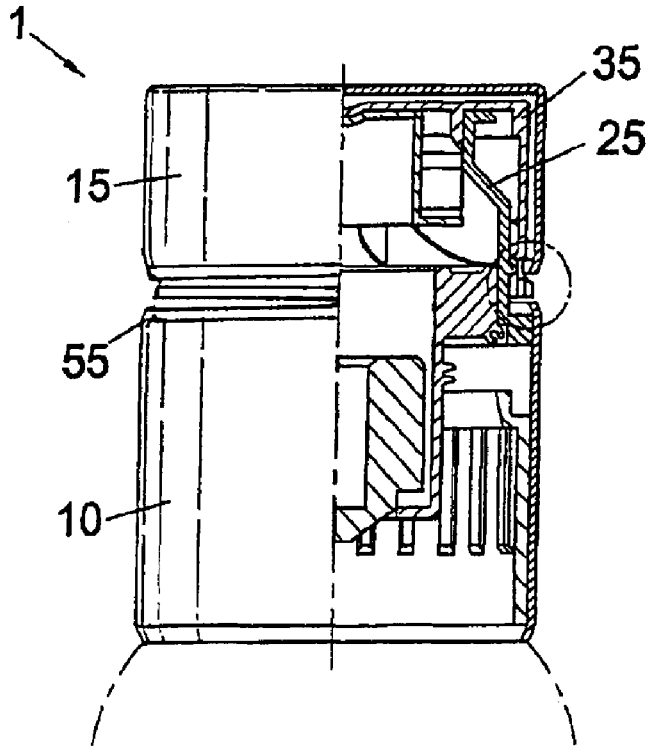
FIG. 3(*a*) a partially cut-away side view of the tamper-evident device of FIG. 1(*a*) with the closure member re-applied.
Figure 3B:
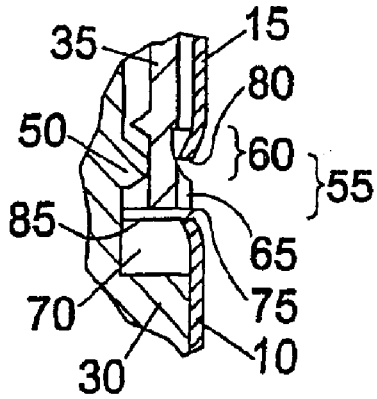

Referring to FIG. 3(*a*) the cap 35 and second portion 15 associated therewith are shown re-applied or reclosed to pouring outlet device 25, and the first and second portions 10, 15 respectively are clearly shown in a spaced apart relationship to one another due to the appearance of gap 55.

Referring to FIG. 3(*b*), there is shown groove 60 provided on cap 35 and an edge 80 of the second portion 15 remaining within groove 60. An edge 75 of first portion 10 is shown in a circumferentially contracted state having moved out of groove 60 upon removal of cap 35 from pouring outlet device 25. A portion of the cap 35 which is located below groove 60, shown as lip 65, rests upon the edge 75 of the first portion 10 resulting in a void 70 which remains between a lower edge 85 of cap 35 and a cap seating surface 90 of second sleeve member 30. Lip 65 is clearly visible to an observer as it is positioned in gap 55 between the first and second portions 10, 15.

In this embodiment the first sleeve member 5 is made from rolled aluminum, and the frangible portion 20 is formed from nine shearable links (not shown) which shear on relative twisting of the cap 35 (and associated second portion 15) and the pouring outlet device 25 (and associated first portion 10).

Furthermore the aluminum sleeve 5 may be coated with inks, paint or the like, and may be further provided with printed matter and advantageously good reproducibility of colors is obtained when using colored printed matter.

Figure 4:
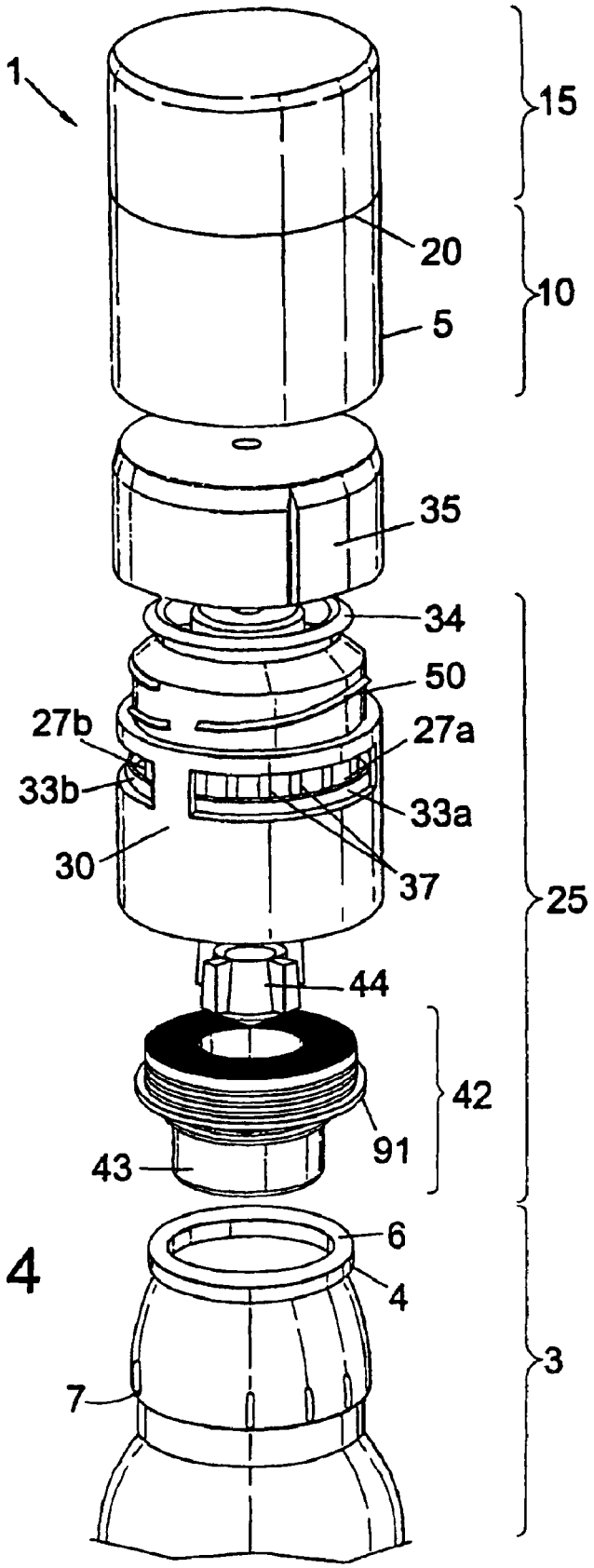
FIG. 4 an exploded perspective view of the tamper-evident device of FIG. 1 including a pouring outlet device and in combination with a bottle having a mouth and neck.

Referring now to FIG. 4, there is shown an exploded perspective view of tamper-evident device 1 comprising sleeve member 5, cap 35, pouring outlet device 25. Also shown is a mouth and neck portion 4 of a container or bottle 3.

The pouring outlet device 25 comprises further sleeve member 30 having apertures 27*a*, 27*b* and 27*c* (27*c* not shown) with projection means 33*a*, 33*b* and 33*c* (33*c* not shown) located on lower edges of the apertures 27*a*, 27*b* and 27*c*, respectively. The further sleeve member 30 further has a pouring lip 34, inner surface ribs 37 and a thread portion 50.

The projection means 33*a*, 33*b* and 33*c* are movable radially of the further sleeve member 30 in a stiffly resilient manner, and are resiliently engagable with an outer lip portion of the container 3, which in this embodiment is shown as shoulder 6 of the neck portion 4.

In this embodiment twenty-four ribs 37 are formed and arranged circumferentially on an inner surface of the second sleeve member 30. When the pouring outlet device 25 is applied to bottle neck 4, in use, these ribs 37 co-act with raised ridges 7 on the outer surface of the neck 4 portion to help prevent undesired rotational movement of the further sleeve member 30. Some minor rotational play in either a clockwise or anticlockwise direction may occur until a stop position is found by a rib or ribs 37 acting against a raised ridge or ridges 7. However, continued application of force will cause the first portion 10 and/or second portion 15, to rotate relative to the further sleeve member 30 and/or cap 35, respectively.

A valve seat body 42 and a valve member 44 are also shown. A tubular portion 43 of the valve seat body 42 is adapted to be received within the mouth portion 6 of the bottle.

The first portion 10 and second portion 15 of the first sleeve member 5 are attached by a frangible portion 20 which breaks and allows the cap 35 to be removed with the second portion 15 when it is twisted away from the pouring outlet device 25 by a user in an opening operation.

The sleeve member 5, cap 35 and pouring outlet device 25 are conveniently assembled to give a single unit ready for simple application to a bottle neck, thus enhancing the efficiency of manufacture, bottle filling and assembly process. The valve seat body 42 is held in association with the further sleeve member 30 by resilient rib 91 on the valve seat body 42 co-acting with inner facing detect means carried within the further sleeve member 30, e.g. an annular rib, not shown.

Typically, the bottle 3 is made from glass or alternatively a plastics material, the first sleeve member 5 from aluminum, the cap 35 from low density polyethylene, the further sleeve member 30 from a stiffly resilient plastics material such as polypropylene or polystyrene (and which in this embodiment is a polystyrene obtainable under the trade name, Styrolux), the valve member 44 from crystal polystyrene, and the valve seat body 42 from low density polyethylene.

A non-return valve is formed from the valve seat body 42 and valve member 44 which is closed in a normally upright position of the bottle 3, which while allowing liquids to flow from the bottle 3 in a pouring operation, restricts in-flow of liquid into the bottle 3 by rudimentary unauthorized filling operations or even more sophisticated methods which may involve insertion of objects, tubes or the like into a mouth of the bottle.

Figure 5A:
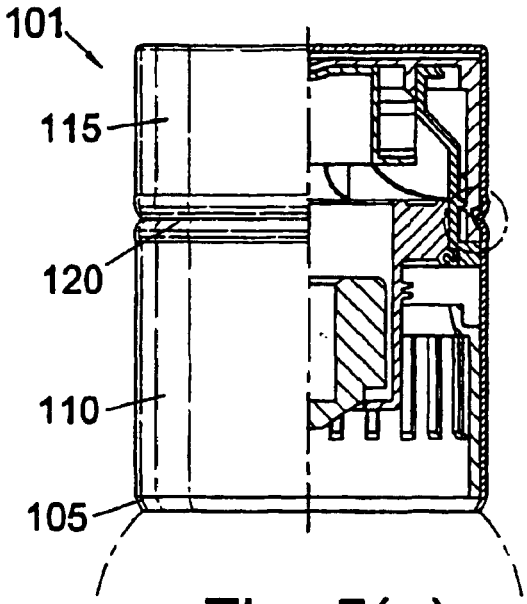
FIG. 5(*a*) a partially cut-away side view of a tamper-evident device according to a second embodiment of the present invention including a pouring outlet device and in combination with a bottle neck shown in phantom lines.
Figure 5B:
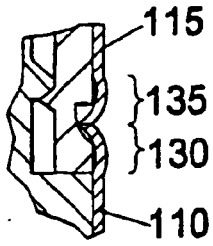

Referring now to FIG. 5(*a*), there is shown a tamper-evident device generally designated 101, according to second embodiment of the present invention. The device 101 is similar in many respects to the device 1 of the first embodiment, like parts being identified by like numerals but increased by 100.

Device 101 comprises a first sleeve member 105 having a first portion 110 and a second portion 115 associated by means of frangible portion 120.

FIG. 5(*b*) clearly shows a first beaded portion 130 provided on the first portion 110 and a second beaded portion 135 provided on the second portion 115.

Figure 6:
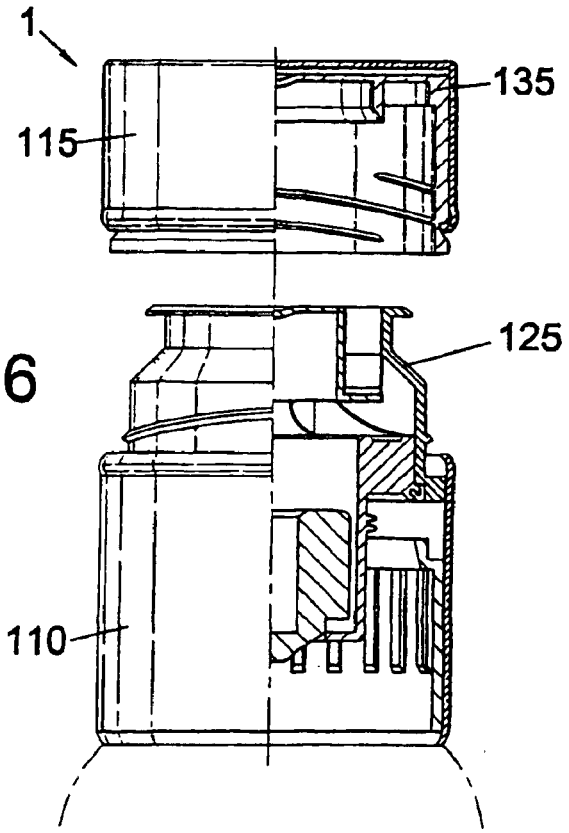
FIG. 6 a partially cut-away view of the tamper-evident device of FIG. 5(*a*) in use with a closure member thereof removed.

Referring to FIG. 6, in the same manner as described hereinbefore regarding the first embodiment, cap 135 and associated second portion 115 may be removed by twisting away from the pouring outlet device 125 and first portion 110 associated therewith.

Figure 7A:
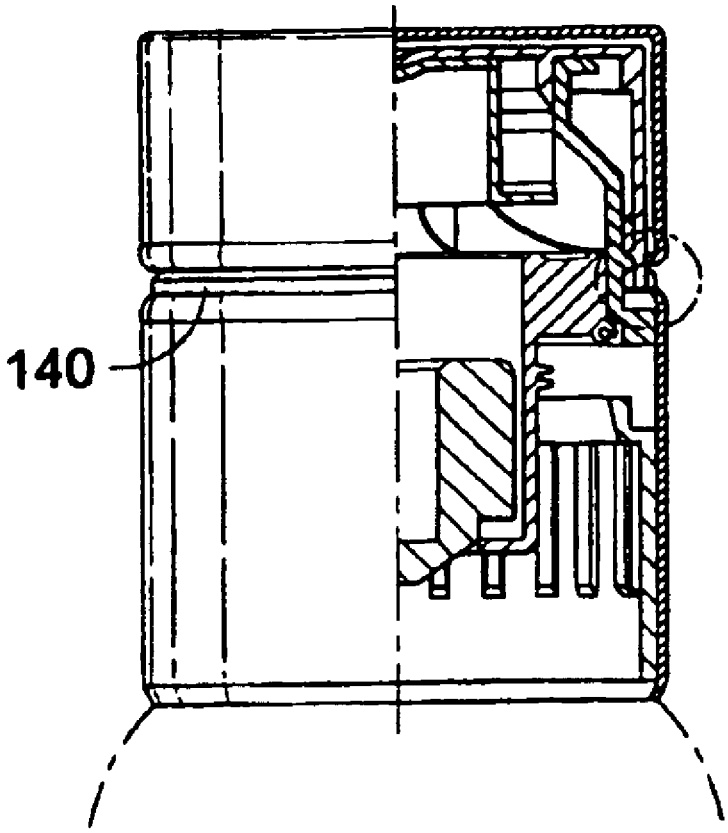
FIG. 7(*a*) a partially cut-away side view of the tamper-evident device of FIG. 5(*a*) with the closure member re-applied.
Figure 7B:
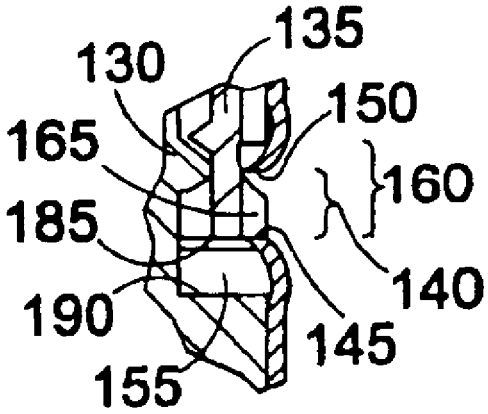

Referring to FIG. 7(*a*), cap 35 and second portion 115 are shown reapplied (reclosed) to the pouring outlet device 125 and a gap 140 remains between the first and second portions 110 and 115.

Referring now to FIG. 7(*b*) in the same manner as hereinbefore described regarding the first embodiment, edge 150 remains in groove 160 of cap 135, and lip 165 rests upon edge 145 of the first beaded portion 130 of the first portion 110, resulting in void 155 formed between lower edge 185 of cap 135 and the cap seating surface 190.

Figure 8:
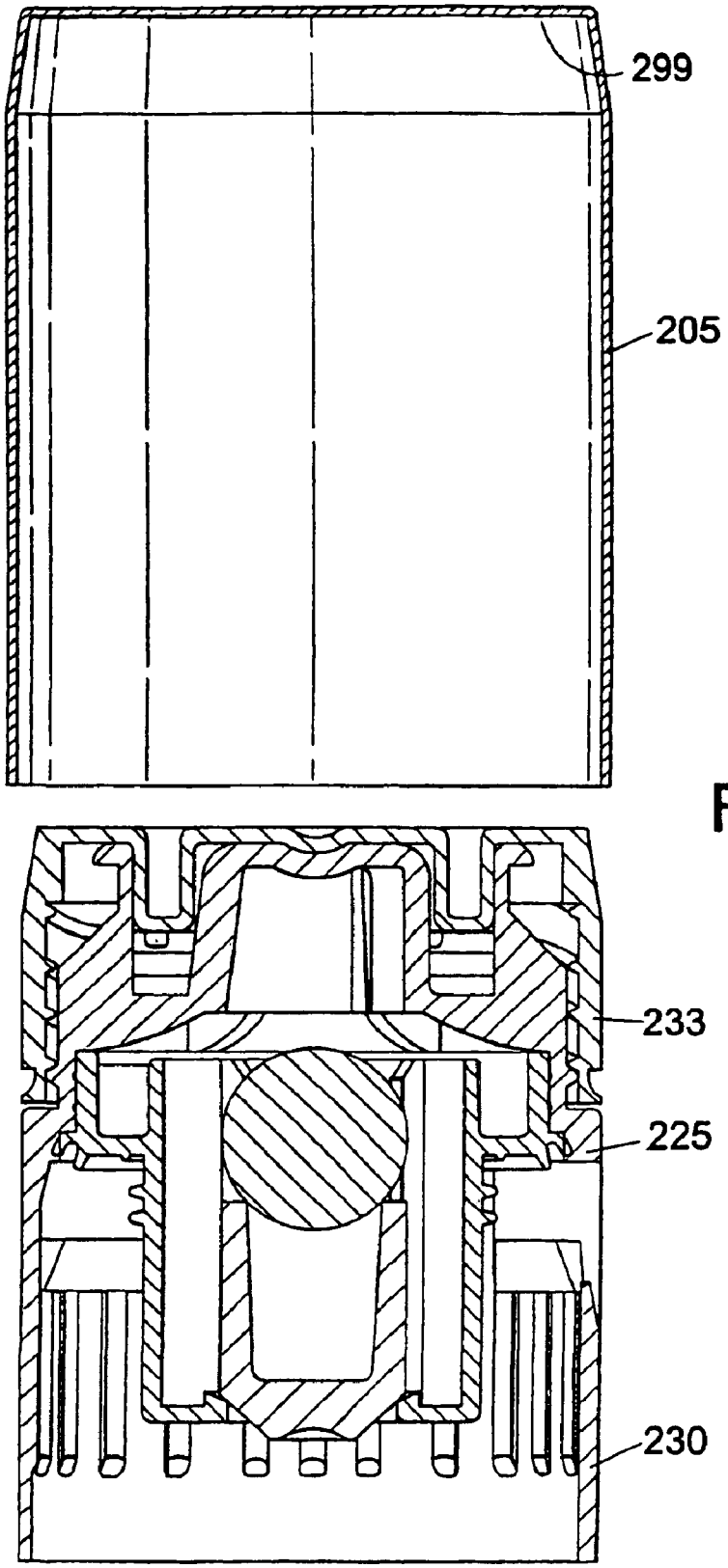
FIG. 8 a cross-sectional view of the tamper-evident device according to a third embodiment of the present invention during initial steps of manufacture.
Figure 9:
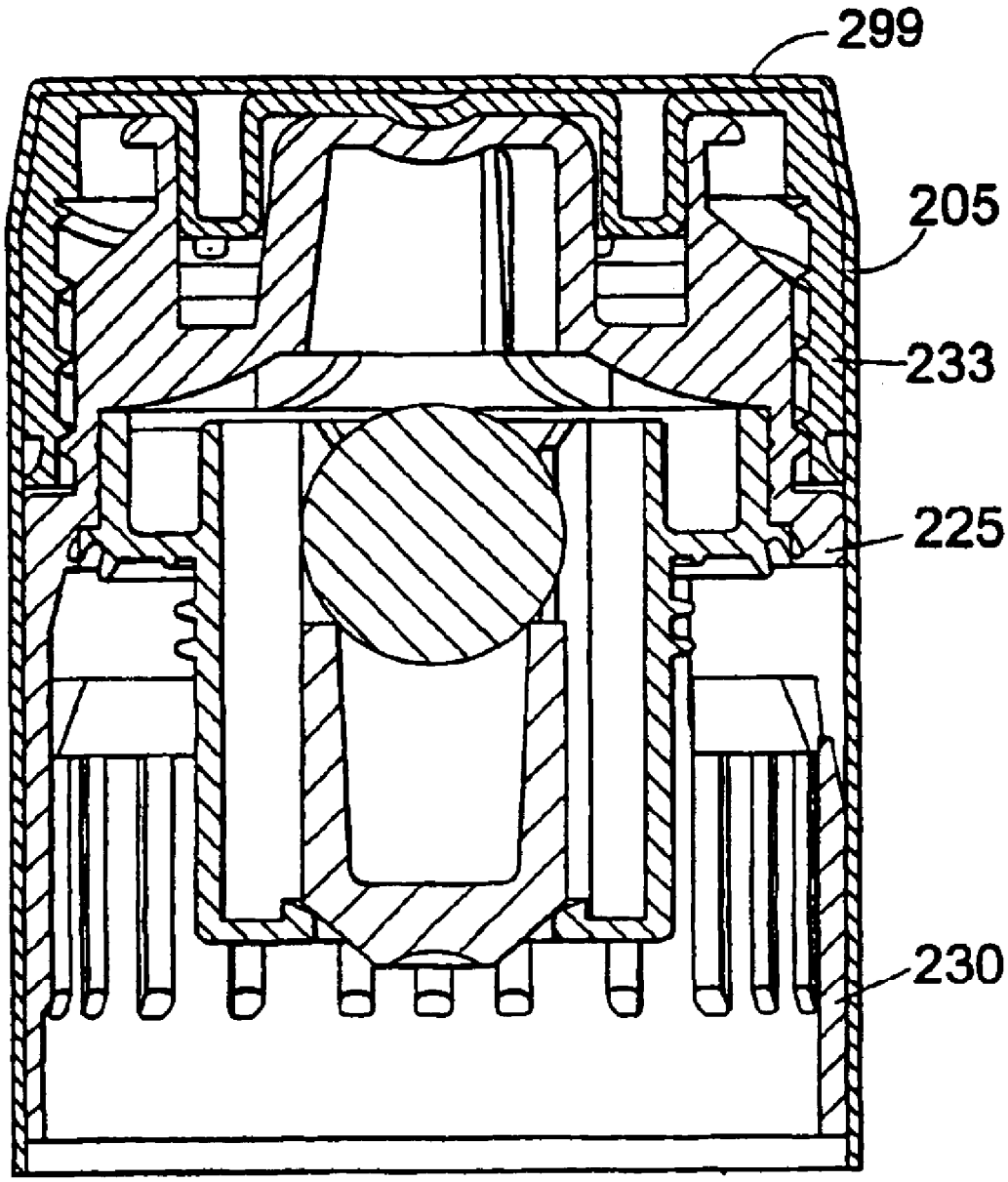
FIG. 9 a cross-sectional view of the tamper-evident device of FIG. 8 during an intermediate step of manufacture.
Figure 10:
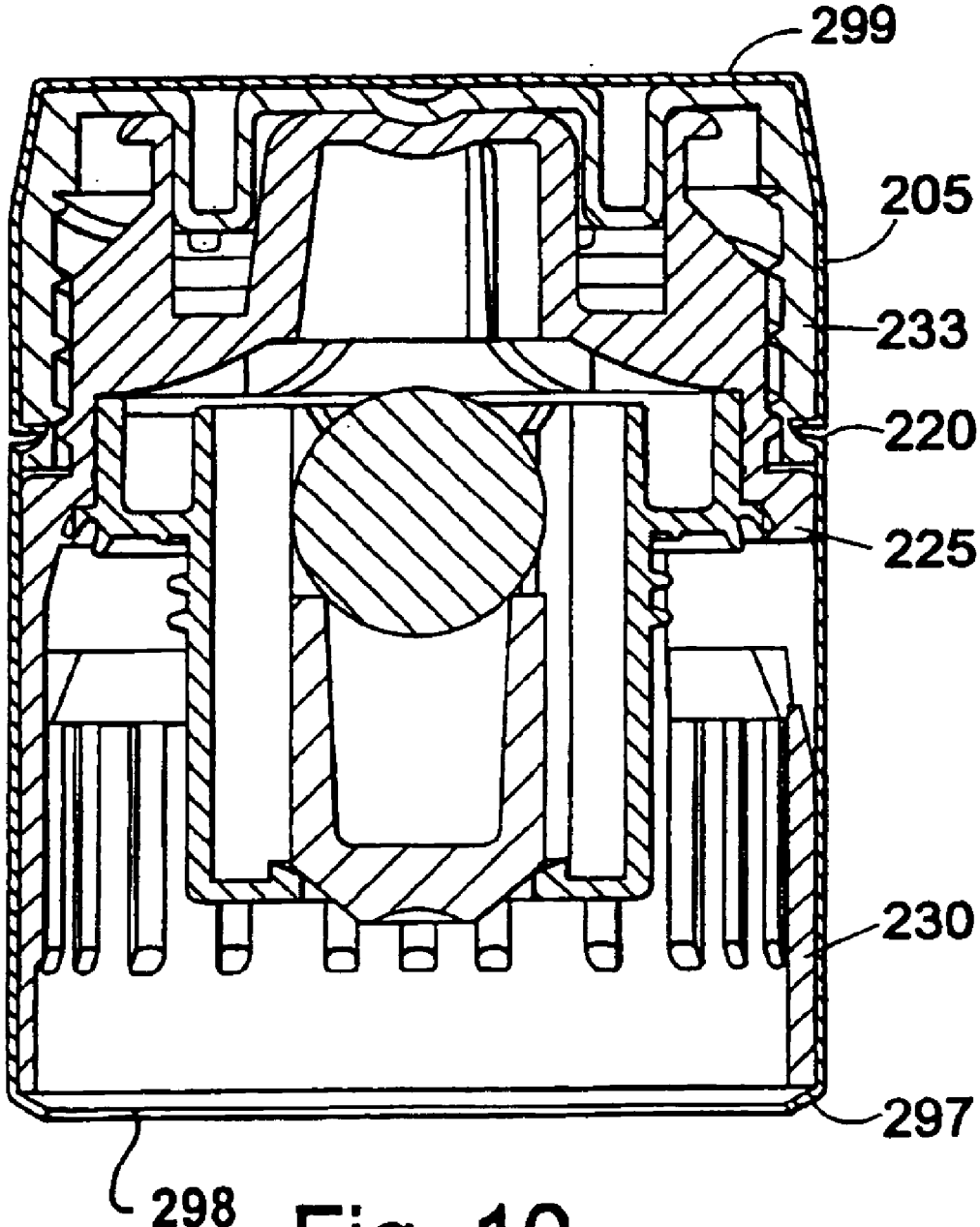
FIG. 10 a cross-sectional view of the tamper-evident device of FIG. 8 after manufacture and prior to initial opening.

Referring finally to FIGS. 8, 9 and 10, there are illustrated sequential steps in a method of manufacturing a tamper-evident device 201 according to a third embodiment of the present invention. The device 201 may be the same as or similar to the device 1 or the device 101 of the first or second embodiments, respectively, like parts being identified by like numerals but increased by 100 or 200, respectively.

The method comprises:

(a) providing sleeve member 205;

(b) providing pouring outlet device 225 comprising further sleeve member 230 adapted to be secured to a mouth and neck portion of a bottle (not shown), and container closure member 233 releasably securable to further sleeve member 230 (see FIG. 8);

(c) disposing the pouring outlet device 225 within the sleeve member 205 (see FIG. 9); and (d) forming substantially circumferential frangible portion 220 around sleeve member 205 (see FIG. 10).

Further, either before or after step (d), but preferably substantially simultaneously with step (d) the method further comprises:

(e) forming an annular lip 297 at an open end 298 of the sleeve member 205 so as to entrap the pouring outlet device 225 within the sleeve member 205.

It will be appreciated that other end 299 of the sleeve member 205 is closed.

The frangible portion 220 and annular lip 297 may be formed using respective blades on a machine tool.

It will be understood that modifications may be made to the embodiments hereinbefore described without departing from the scope of the present invention, for example, the sleeve member 5, 105, 205 may be applied to various different designs of pouring outlet device adapted to be applied to a variety of containers including bottles.

In a modification, for example, the second portion 15, 115 and/or the first portion 10, 110 may include knurred surfaces to assist in gripping in opening and reopening of the device 1, 101.

It will further appreciated that the present invention provides a particularly desirable one piece snap on fitment have functional advantages over the prior art as well as enhanced aesthetic appeal.

What is claimed is:

1. A tamper-evident device comprising: a sleeve member which comprises a first portion which prior to initial opening is associated with a second portion by a frangible portion therebetween, means for securing the first portion to a mouth and neck portion of a container, and a container closure member with which the second portion is associated, wherein prior to an initial container opening operation a circumferential edge of the first portion is disposed longitudinally between a circumferential edge of the second portion and a circumferential lip of the container closure member, and wherein further an initial container opening operation causes the frangible portion to fracture or break, and upon reclosure of the container the circumferential lip of the container closure member is disposed longitudinally between the circumferential edge of the first portion and the circumferential edge of the second portion such that the circumferential edges are then disposed in a spaced apart relationship to one another.

2. A tamper-evident device as claimed in claim 1, wherein the device comprises non-refillable means.

3. A tamper-evident device as claimed in claim 1, wherein the securing means comprises a further sleeve member adapted to lie around the mouth and neck portion of the container.

4. A tamper-evident device as claimed in claim 3, wherein the securing means also comprises an annular lip provided at an open end of the second portion distal from the mouth of the container.

5. A tamper-evident device as claimed in claim 3, wherein the first portion is disposed circumferentially outwardly of the further sleeve member and is a substantially tight fit therewith but rotatable with respect thereto upon application of sufficient force, and wherein, in use, the first portion remains on the further sleeve member when the container closure member is removed.

6. A tamper-evident device as claimed in claim 3, wherein the further sleeve member includes means for fixing the further sleeve member to the container, the fixing means comprising first means for fixing the further sleeve member on the container so as to restrain rotational movement of the further sleeve with respect to the neck portion of the container, and the fixing means comprises second means for fixing the further sleeve member on the container so as to restrict longitudinal movement of the further sleeve member with respect to the mouth of the container.

7. A tamper-evident device as claimed in claim 1, wherein the second portion is disposed circumferentially outwardly of the container closure member and is substantially tight fit therewith but rotatable with respect thereto upon application of sufficient force.

8. A tamper-evident device as claimed in claim 1, wherein the frangible portion is provided between the initially adjacent circumferential edges of the first and second portions.

9. A tamper-evident device as claimed in claim 1, wherein either or both of the circumferential edges retracts or recoils away from the other during an initial container opening operation when the frangible portion fractures or breaks.

10. A tamper-evident device as claimed in claim 9, wherein the retraction or recoil is accompanied by a concomitant circumferential contraction of at least one of the circumferential edges inwardly of the respective first or second portion to provide at least one circumferential edge having a smaller circumference or diameter than an adjacent portion of the respective first or second portion.

11. A tamper-evident device as claimed in claim 10, wherein the retraction or recoil results in a permanent deformation of the first and/or second portions, and when the container is redosed the circumferential edges do not abut together thus revealing a void or gap located between the first and second portions such visual indicator evidencing that the tamper-evident device has been opened.

12. A tamper-evident device as claimed in claim 1, wherein the container closure member includes a circumferential groove, the circumferential lip located below and adjacent to the circumferential groove.

13. A tamper-evident device as claimed in claim 12, wherein during an initial container opening operation the circumferential edge of the second portion recoils/retracts and circumferentially contracts into the circumferential groove to become positioned circumferentially behind the circumferential lip.

14. A tamper-evident device as claimed in claim 1, wherein the frangible portion is selected from one of or a combination of a continuous weakened portion, a circumferential scored line, or a plurality of intermittent shearable links which join the first portion to the second portion.

15. A tamper-evident device as claimed in claim 1, wherein the circumferential edge of the first portion provides a circumferential first beaded portion on the first portion and the circumferential edge of the second portion provides a circumferential second beaded portion on the second portion.

16. A tamper-evident device as claimed in claim 1, wherein the sleeve member substantially comprises a metal or metallic based material.

17. A tamper-evident device as claimed in claim 16, wherein the metal or metallic based material substantially comprises aluminum.

18. A tamper-evident device as claimed in claim 1, wherein the container closure member is a cap including a threaded portion allowing a rotational movement of the cap during a container opening operation.

19. A tamper-evident device as claimed in claim 1, wherein the tamper-evident device includes a pouring outlet device adapted to be secured to the mouth or neck portion of the container, the container being a container for liquid, and wherein the container closure member is a cap adapted to close an outlet of the pouring outlet device, and wherein the sleeve member is adapted to receive at least part of the pouring outlet device.

20. A tamper-evident device as claimed in claim 19, wherein the second portion of the sleeve member is adapted to receive at least part of the cap.

21. A tamper-evident device as claimed in claim 20, wherein the cap is received in a tight interference fit to the second portion but is rotatable with respect to the second portion of the sleeve member upon application of sufficient force.

22. A tamper-evident device as claimed in claim 19, further comprising non-refillable means, wherein the pouring outlet device circumferentially contains the non-refillable means, and the device comprises a one piece closure assembly for a container for liquid.

23. A tamper-evident device as claimed in claim 19, wherein the pouring outlet device comprises a pouring lip integrally formed with the further sleeve member, and further comprises a value seat body which is at least partially receivable within at least part of the neck portion of the container, the valve seat body being at least partially surrounded by the further sleeve member.

24. A tamper-evident device as claimed in claim 1, wherein prior to initial opening the frangible portion is located in a further circumferential groove provided between or adjacent the first and second portions of the sleeve member.

25. A tamper-evident device as claimed in claim 24, wherein the frangible portion is located substantially at an apex or base of the further circumferential groove.

26. A tamper-evident device as claimed in claim 24, wherein the container closure includes a circumferential groove and the further circumferential groove of the sleeve member is located within the circumferential groove of the container closure member prior to initial opening.

27. A container including a tamper-evident device as claimed in claim 1.

28. A container as claimed in claim 27, wherein the container is a bottle.

29. A container as claimed in claim 28, wherein the container is a glass bottle for containment of an alcoholic drink.

30. A combination of a container and a tamper-evident device according to claim 1.

31. An alcoholic drinks product comprising an alcoholic substance packaged in the combination of claim 30.

32. A method of manufacturing a tamper-evident device as claimed in claim 1, the method comprising the steps of (a) providing a sleeve member; (b) providing a pouring outlet device comprising a further sleeve member adapted to be secured to a mouth or neck portion of a container for liquid, and a container closure member releasably securable to the further sleeve member; (c) disposing the pouring outlet device at least partly within the sleeve member; and (d) forming a substantially circumferential frangible portion around the sleeve member.

33. A method of manufacturing a tamper-evident device as claimed in claim 32, wherein the method includes the further step of securing the sleeve member and pouring outlet device one to the other by forming a lip on an open end of the sleeve member so as to entrap the pouring outlet device within the sleeve member.

34. Atamper-evident device comprising: a sleeve member which comprises a first portion having a circumferential edge and a second portion also having a circumferential edge, wherein prior to initial opening the first and second portipns are associated by a frangible portion therebetween and the respective circumferential edges are closely adjacent one another, means for securing the first portion to a mouth and neck portion of a container, a container closure member with which the second portion is associated, means for spacing the initially adjacent circumferential edges upon reclosure subsequent to initial opening, and wherein, in use, an initial container opening operation causes the frangible portion to fracture or break and when the container is reclosed the circumferential edges of the first and second portions are located in a spaced apart relationship to one another by the spacing means.

35. A tamper-evident device comprising: a sleeve member comprising a first portion and a second portion, means for securing the first portion to a mouth and neck portion of a container, and a container closure member with which the second portion is associated, wherein prior to an initial container opening operation a circumferential edge of the first portion is disposed longitudinally between a circumferential edge of the second portion and a circumferential lip of the container closure member, and wherein further subsequent to an initial container opening operation upon reclosure of the container the circumferential lip of the container closure member is disposed longitudinally between the circumferential edge of the first portion and the circumferential edge of the second portion.

36. A tamper-evident device comprising: a sleeve member which comprises a first portion having a circumferential edge and a second portion also having a circumferential edge, wherein prior to initial opening the respective circumferential edges are closely adjacent one another, means for securing the first portion to a mouth and neck portion of a container, a container closure member with which the second portion is associated, means for spacing the initially adjacent circumferential edges upon reclosure subsequent to initial opening, and wherein, in use, subsequent to an initial container opening operation when the container is reclosed, the circumferential edges of the first and second portions are located in spaced apart relationship to one another by the spacing means.

* * * * *